US012692667B2

(12) United States Patent
Hofstaetter et al.

(10) Patent No.: US 12,692,667 B2
(45) Date of Patent: Jul. 28, 2026

(54) METHOD AND TRACK TAMPING MACHINE FOR TAMPING A TRACK

(71) Applicant: Plasser & Theurer Export von Bahnbaumaschinen Gesellschaft m.b.H., Vienna (AT)

(72) Inventors: Josef Hofstaetter, Puchenau (AT); Heinz Springer, Tokyo (JP)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 848 days.

(21) Appl. No.: 18/019,353

(22) PCT Filed: Sep. 6, 2021

(86) PCT No.: PCT/EP2021/074436
§ 371 (c)(1),
(2) Date: Feb. 2, 2023

(87) PCT Pub. No.: WO2022/058187
PCT Pub. Date: Mar. 24, 2022

(65) Prior Publication Data

US 2024/0254698 A1 Aug. 1, 2024

(30) Foreign Application Priority Data

Sep. 16, 2020 (AT) ..... A 50787/2020

(51) Int. Cl.
*E01B 27/16* (2006.01)
*E01B 27/17* (2006.01)

(52) U.S. Cl.
CPC ..... *E01B 27/16* (2013.01); *E01B 27/17* (2013.01); *E01B 2203/12* (2013.01); *E01B 2203/122* (2013.01)

(58) Field of Classification Search
CPC ..... E01B 27/17; E01B 2203/015; E01B 2203/10; E01B 2203/122; E01B 2203/125; E01B 27/16; E01B 2203/12
See application file for complete search history.

(56) References Cited

U.S. PATENT DOCUMENTS 2,734,463 A * 2/1956 Hursh ..... E01B 27/17 104/12
3,380,395 A 4/1968 Plasser et al.
(Continued)

FOREIGN PATENT DOCUMENTS

AT 513 034 A4 1/2014
CN 1043179 A * 6/1990 ..... E01B 27/12
(Continued)

OTHER PUBLICATIONS

International Search Report in PCT/EP2021/074436 dated Dec. 7, 2021 with English translation.
(Continued)

*Primary Examiner* — Cheng Lin
(74) *Attorney, Agent, or Firm* — Collard & Roe, P.C.; William Collard

(57) ABSTRACT

The invention relates to a method for tamping a plurality of sleepers of a track supported in a ballast bed by means of a plurality of tamping units arranged one behind the other on a machine frame of a track tamping machine with tamping tools opposite each other in pairs, with only one sleeper being tamped by means of the respective tamping unit during a tamping process. In this context, a control device for actuating longitudinal actuators is given a sleeper spacing of the sleepers to be tamped, with the tamping units being positioned towards each other in the longitudinal direction of the machine by means of the longitudinal actuators prior to a tamping process in order to adjust the positions of the tamping units to the given sleeper spacing,
(Continued)

and with sleepers not arranged directly one behind the other being tamped during the tamping process. Due to the distance of the tamping units from each other in the longitudinal direction of the machine by more than one sleeper spacing respectively, sufficient free space to adjust to different sleeper spacings is available.

13 Claims, 6 Drawing Sheets

(56) References Cited

U.S. PATENT DOCUMENTS

| | | | | | |
|---|---|---|---|---|---|
| 3,504,635 | A * | 4/1970 | Stewart | E01B 27/16 | 104/12 |
| 3,687,081 | A * | 8/1972 | Plasser | E01B 27/17 | 104/7.2 |
| 3,710,721 | A * | 1/1973 | Stewart | E01B 27/16 | 104/12 |
| 3,744,428 | A * | 7/1973 | Plasser | E01B 27/17 | 104/8 |
| 4,760,797 | A * | 8/1988 | Stubbs | E01B 27/16 | 701/19 |
| 9,546,453 | B2 * | 1/2017 | Springer | E01B 27/16 | |
| 11,072,891 | B2 * | 7/2021 | Ganz | E01B 27/20 | |
| 11,492,764 | B2 * | 11/2022 | Buerger | E01B 27/17 | |
| 2007/0283836 | A1 * | 12/2007 | Theurer | E01B 27/16 | 104/12 |
| 2020/0181850 | A1 | 6/2020 | Kopf et al. | | |
| 2022/0025585 | A1 | 1/2022 | Springer | | |

FOREIGN PATENT DOCUMENTS

| | | | |
|---|---|---|---|
| DE | 1534085 | A1 | 5/1969 |
| DE | 1 534 080 | A1 | 11/1969 |
| DE | 2114281 | A1 | 11/1971 |
| EP | 0564433 | A1 | 10/1993 |
| JP | S51-69811 | A | 6/1976 |
| JP | S5235010 | A | 3/1977 |
| JP | H08246404 | A | 9/1996 |
| JP | 2020519785 | A | 7/2020 |
| JP | 2020521897 | A | 7/2020 |
| WO | 2018/206214 | A1 | 11/2018 |
| WO | 2018/219570 | A1 | 12/2018 |
| WO | 2020/135973 | A1 | 7/2020 |

OTHER PUBLICATIONS

Austrian Search Report in Austrian Application No. A 50787/2020 dated Jul. 16, 2021.

Matisa, Hochleistungs-Universal-Stopfmaschinen, Jul. 2018-nn, https://www.matisa.ch/brochures_pdf/de/bourreuses_universelles_de.pdf, with English translation, 11 pages.

* cited by examiner

METHOD AND TRACK TAMPING MACHINE FOR TAMPING A TRACK

CROSS REFERENCE TO RELATED APPLICATIONS

This application is the National Stage of PCT/EP2021/074436 filed on Sep. 6, 2021, which claims priority under 35 U.S.C. § 119 of Austrian Application No. A50787/2020, filed on Sep. 16, 2020, the disclosure of which is incorporated by reference. The international application under PCT article 21(2) was not published in English.

FIELD OF TECHNOLOGY

The invention relates to a method for tamping a plurality of sleepers of a track supported in a ballast bed by means of a plurality of tamping units arranged one behind the other on a machine frame of a track tamping machine with tamping tools opposite each other in pairs, with only one sleeper being tamped by means of the respective tamping unit during a tamping process. In addition, the invention relates to a machine for carrying out the method.

PRIOR ART

In order to restore or maintain a given track position, tracks with ballast beds are regularly maintained by means of a tamping machine. In the process, the tamping machine travels along the track and lifts the track panel formed of sleepers and rails to a target level by means of a lifting and lining unit. The new track position is fixed by tamping the sleepers by means of a tamping unit. The tamping unit comprises tamping tools with tamping tines which, during a tamping process, penetrate the ballast bed while being subjected to vibration and being squeezed towards each other. In the process, the ballast is pushed below the respective sleeper and compacted.

In particular, plain-line tamping machines use tamping units for the simultaneous tamping of a plurality of sleepers. Given the resulting high working speed, the track can be maintained in short track possessions. Modern tamping machines are also characterised by low wear effects on both the tamping unit and the ballast.

A method and a generic track tamping machine with a plurality of tamping units arranged one behind the other is known from AT 513 034 A1. Each tamping unit is arranged height-adjustably in a shared tamping unit carrier. A tamping process begins with the tamping units being lowered simultaneously. The simultaneous lowering of adjacent tamping units for the tamping of adjacent sleepers in the longitudinal direction of the machine takes place with a time delay. This facilitates in particular the penetration of directly adjacent tamping tines penetrating a shared sleeper crib.

Adjustment to different sleeper spacings is only possible to a limited extent with such tamping units by changing the opening width of the tamping tools opposite each other in pairs. Specifically, the lower lever arms of the non-adjacent tamping tools are moved outwards. The tamping tines attached to the lower lever arms are thereby tilted, with disadvantages when penetrating the ballast bed and when raising the tamping tines.

Presentation of the Invention

The object of the invention is to improve a method of the kind mentioned above in such a way as to achieve high-quality tamping results when adjusting flexibly to different sleeper spacings. A further object of the invention is to provide a correspondingly improved track tamping machine.

According to the invention, these objects are achieved by the features of claims 1 and 9. Dependent claims indicate advantageous embodiments of the invention.

It is provided that a control device for actuating longitudinal actuators is given a sleeper spacing of the sleepers to be tamped, that, prior to a tamping process, the tamping units are positioned towards each other in the longitudinal direction of the machine by means of the longitudinal actuators in order to adjust the positions of the tamping units to the given sleeper spacing, and that sleepers not arranged directly one behind the other are tamped during the tamping process. The distance of the tamping units from each other in the longitudinal direction of the machine by more than one sleeper spacing respectively provides sufficient free space. Even with different sleeper spacings, each tamping unit can be positioned exactly above a sleeper to be tamped without changing the position of the tamping tools.

In addition, it prevents tamping tools of the tamping units positioned one behind the other from penetrating the same sleeper crib. This protects both the tamping units and the ballast. Each tamping tine located on the tamping tools performs the same penetration process, with low penetration resistance and without interference from tamping tines of the other tamping units. Even with narrow sleeper cribs, sufficient squeezing distances are available to ensure optimum tamping of the respective sleeper. These uniform conditions for all tamping tines result in homogeneous multiple-sleeper tamping with consistent, optimised compaction processes. For example, drifting of ballast between a tamping tine plate arranged at the respective tamping tine end and a lower edge of the sleeper is prevented because the ballast can be squeezed sufficiently.

In a further development of the method, progressions of a ballast force acting on the tamping tool over a distance the tamping tool covers are detected during a tamping process for each tamping unit by means of force and/or movement sensors arranged on an associated tamping tool, in order to derive a parameter for compaction control. Due to the distance in the longitudinal direction of the machine by a multiple of the sleeper spacing, each tamping unit provides accurate measuring results without being influenced by the other tamping units. Thus, the methods for the determination of a parameter described in the publication AT 520056 A1 are equally applicable to all tamping units. This also enables a continuous compaction control in real time for the present multiple-sleeper tamping.

A further improvement provides that, prior to a tamping cycle, the positions of the sleepers are detected by means of a sensor device arranged on the track tamping machine and that the current sleeper spacing is derived from the detected positions. A corresponding sensor device is known from AT 519739 A4. In this way, the tamping unit positions are automatically adjusted to different sleeper spacings. The sensor device is also suitable for a further automation of multiple-sleeper tamping. In this context, sensor data are used to specify a tamping position for each tamping tool. An operator confirms suggested tamping positions or monitors a fully automatic operation of the track tamping machine.

Advantageously, a track panel formed of sleepers and rails fixed thereon is lifted and laterally lined prior to tamping by means of a lifting and lining unit, with a vertical position and a horizontal position of the rails being detected by means of a measuring device positioned in front of the tamping unit at the very front. The front track-height measuring unit at the tamping unit at the very front places the track panel into a given track position with high accuracy.

In this context it is advantageous if, during a first tamping process at the beginning of worksite maintenance, only the tamping unit at the very front tamps once so that the track panel is fixed in a lifted vertical position and a lined horizontal position. The track panel is fixed in the immediate vicinity of the measuring device, thus achieving a high quality of the resulting track position.

A further improvement provides that in the case of three tamping units arranged one behind the other at a distance that is double the sleeper spacing, all three tamping units are moved forward by three sleeper spacings in the direction of work after the first tamping process, that tamping is carried out only with the very front and the middle tamping unit during a second tamping process, that all three tamping units are moved forward again by three sleeper spacings in the direction of work after the second tamping process, and that tamping is carried out with all three tamping units during a third tamping process. With this sequence of steps of the method, every sleeper is efficiently tamped right at the beginning of the worksite. In the process, a uniform ramp forms at the beginning of the maintained track section compared to the connecting unmaintained track.

It is useful, in the case of three tamping units arranged one behind the other at a distance that is double the sleeper spacing, that after an initial tamping of sleepers positioned directly one behind the other, all tamping units are moved forward by three sleeper spacings in the direction of work prior to a tamping process, with tamping being carried out with all three tamping units during a tamping process. This 3-sleeper mode is retained even with modified sleeper spacing. There is no need to switch to a 1-sleeper or 2-sleeper mode. Thus, fast multiple-sleeper tamping with high maintenance quality is achieved. The use of three tamping units represents an optimum between the necessary length of the track tamping machine or the distance between the rail-based running gears and the achievable work speed. The lifted track panel section to be fixed also has an optimum length with regard to the bending radii that occur when three tamping units are used.

However, in order to further increase the work speed, it is also useful to increase the length of the track maintenance machine or the distance between the rail-based running gears in order to arrange four tamping units arranged one behind the other with double sleeper spacing. For a simpler design of the track maintenance machine, an arrangement of two tamping units arranged one behind the other with double sleeper spacing is also useful.

A further improvement of the method provides that for tamping Y-sleepers, one rail is tamped using the tamping unit at the very front, and that the other rail is tamped using the tamping unit positioned behind the very front one. This further expands the track tamping machine's range of applications.

A track maintenance machine according to the invention comprises a plurality of tamping units arranged one behind the other on a machine frame for the simultaneous tamping of a plurality of sleepers of a track, each tamping unit comprising a tamping tool carrier adjustable in height by means of a height-adjustment drive, with tamping tools opposite each other in pairs being mounted on the tamping tool carrier, which can be set in vibration via drives and can be squeezed towards each other. The machine is adapted to carry out one of the methods mentioned in such a way that the tamping units can be shifted towards each other in the longitudinal direction of the machine by means of longitudinal actuators, and that the longitudinal actuators can be actuated by means of a shared control device in order to position the tamping units at a distance from each other which corresponds to a multiple of a given sleeper spacing. Such a multiple-sleeper tamping machine can be used for flexible, efficient, and high-quality maintenance of plain line tracks.

Advantageously, each tamping tool comprises a tamping tine at a lower free end which is vertically aligned in a penetration position. This achieves a fast and gentle penetration process in the ballast bed, with a low load on the tamping tools and other components of the unit. Due to the low penetration volume, the ballast is also subjected to low loads, thus preventing undesirable ballast destruction. In addition, the gentle penetration process results in a low noise emission. The faster penetration process vis-à-vis tamping tines penetrating slantwise increases the overall work speed of the machine. In addition, the vertically aligned tamping tines leave a smaller void, into which ballast slides, when they are lifted out of the ballast bed. This retains the desired compaction as a result.

A further improvement provides that a main frame supported on running gears is movable on the track, and that the machine frame with the tamping units is arranged so it can be shifted in relation to the main frame in the longitudinal direction of the machine. During work, the main frame with driver's cabs, traction drive, and other heavy devices moves continuously along the track, which means that these masses do not have to be braked and accelerated for each tamping cycle. Only the machine frame with the tamping units is stopped during a tamping cycle, resulting in a shifting against the driving direction in relation to the main frame. At the end of a tamping cycle, the machine frame is moved to the new tamping position, with a shifting taking place in relation to the main frame in driving direction. This embodiment combines a fast mode of operation with an energy-efficient forward movement of the machine.

Furthermore, it is advantageous if the respective tamping unit is symmetrically constructed with respect to a symmetry plane orthogonal to the longitudinal direction of the machine. This results in equal vibration amplitudes of the tamping tools opposite each other in pairs. During the tamping process, the corresponding tamping tines act simultaneously on the ballast grains located between them (same tamping tine dynamics in opposite directions). The result is a homogeneous compaction with effective energy input into the ballast bed.

Advantageously, the tamping units arranged one behind the other are identical in construction. The resulting identical unit parts simplify the construction of the machine. Servicing work can thus be performed with less effort in a shorter time, with fewer different spare parts being required in total.

A further improvement provides that each tamping unit comprises a plurality of tamping unit segments arranged next to each other crosswise to the longitudinal direction of the machine, which are attached to a shared carrier device and, in particular, have tamping tool carriers that can be adjusted in height separately. This increases the machine's flexibility of use. For example, in turnout sections or when there are obstacles in the track, only those tamping unit segments having tamping tools that can penetrate a free sleeper crib are activated.

In addition, it is advantageous if one of the tamping units arranged one behind the other is fixed to the machine frame and if the other tamping units are mounted on longitudinal guide rods coupled to the machine frame. This way, the mechanical connection of the tamping units to the machine frame is constructed in a simple manner, without restricting the shiftability of the tamping units towards each other. In the case of three tamping units arranged one behind the other, preferably the tamping unit at the very front and the tamping unit at the very end are mounted on the machine frame by means of a longitudinal guide rod.

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
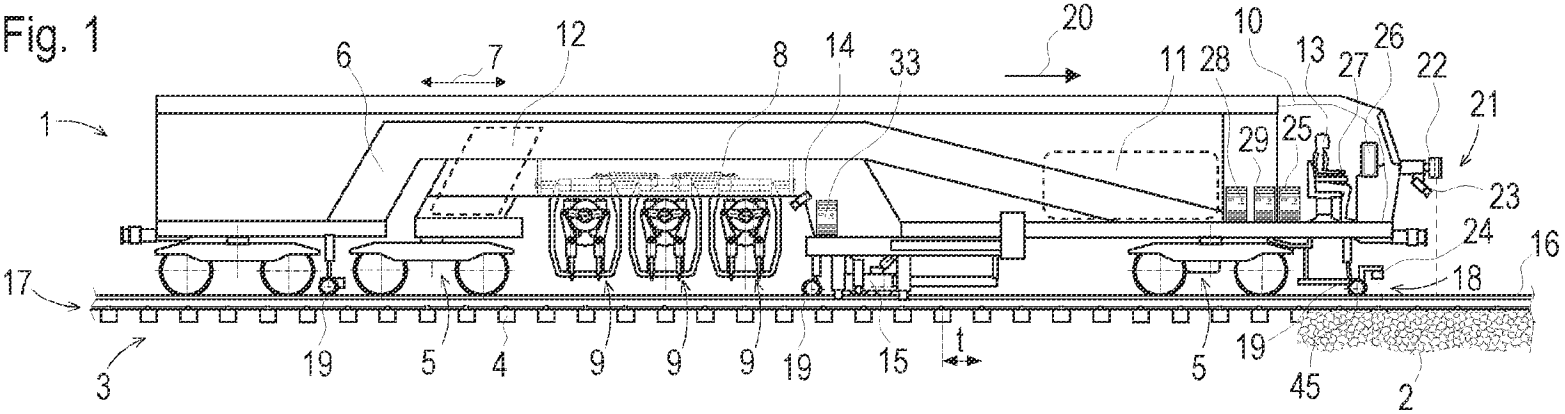
FIG. 1 Track tamping machine with three tamping units

The track tamping machine 1 shown in FIG. 1 is designed for the simultaneous tamping of three sleepers 4 supported in a ballast bed 2 of a track 3. The machine 1 comprises a main frame 6 supported on rail-based running gears 5. A machine frame 8 that can be shifted in the longitudinal direction of the machine 7 is mounted on the main frame 6, on which three tamping units 9 are attached one behind the other. In a simpler variant not shown, the machine 1 comprises only a machine frame 8 supported on rail-based running gears 5. In this, the machine frame 8 is also the main frame.

A driver's cab 10 and a traction drive 11 are arranged on the main frame 6. Depending on the degree of automation, there is an additional operator's cab 12 behind the tamping units 9. From this cab 12, an operator 13 has a clear view of the tamping units 9 to make adjustments. In addition or as an alternative, a video system 14 is arranged. The positions and working positions of the tamping units 9 are thus displayed in the driver's cab 10 and can be monitored and influenced from there by the operator 13.

The machine 1 further comprises a lifting and lining unit 15 for lifting and lining the track panel 17 formed of sleepers 4 and rails 16 fixed thereon. A current track position is recorded by means of a measuring system 18. This measuring system 18 comprises a measuring device 19 directly in front of the tamping unit 9 at the very front and, for referencing vis-à-vis the track 3, a measuring device 19 in the front area and the rear area of the machine 1 respectively.

As seen in a direction of work 20, a sensor device 21 is arranged on the front end of the track maintenance machine 1. This sensor device 21 comprises, for example, a laser rotation scanner 22, a colour camera 23, and several laser line scanners 24. The laser rotation scanner 22 provides a three-dimensional point cloud of the track 3 including its surroundings during forward driving. The laser line scanners 24 are aimed at the rail webs and rail fastenings to cover shadowed areas. The colour camera 23 continuously captures photographic images of the track 3.

The data captured by means of the sensor device 21 is processed in a computing unit 25 (e.g. computer with data memory). First, a three-dimensional model of the track 3 and its surroundings is calculated from the point cloud and the colour images. By means of object recognition disclosed in AT 518692 A1 of the same applicant, sleepers 4, sleeper cribs, rails 16, and obstacles are identified in the model. A sleeper spacing t of the track section to be maintained is also captured. This is done, for example, on the basis of the detected position of the rail fastenings. In this context, the sleeper spacing t is the distance between the successive sleepers 4 in the longitudinal direction of the track.

Subsequently, a respective working position of the units 9, 15 is automatically preset for each track point at which a work process is to be carried out. This also applies in particular to a respective distance a of the tamping units 9 from each other in the longitudinal direction of the machine 7. In the example shown, double the sleeper spacing t is given as the distance a. In the driver's cab 10 or in the operator's cab 12, a display device 26 (monitor, touch screen, etc.) is arranged, on which the identified positions of the units 9, 15 are displayed. In addition, operating elements 27 are arranged in the corresponding cab 10, 12. By means of these, an operator 13 can change the working positions of the units 9, 15 before carrying out the work process. When confirmed, the automatically preset working positions are given to a machine control 23 for actuating the units 9, 15.

In addition to the sensor device 21 and the machine control 23, a sensor and control system of the machine 1 comprises a so-called guiding computer 29. This guiding computer 29 presets a target geometry of the track 3 and correction values derived from it for lateral lining and levelling of the track 3.

Figure 2:
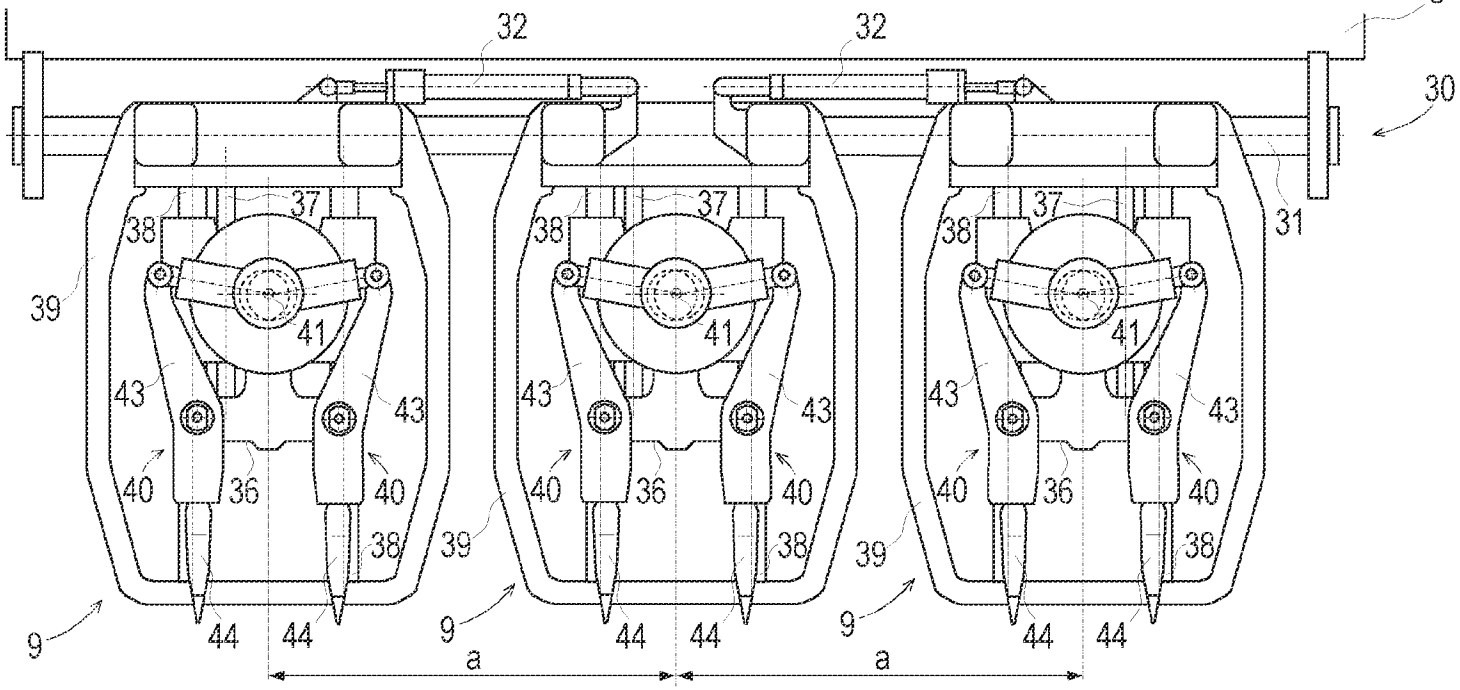
FIG. 2 Tamping unit for the simultaneous tamping of three sleepers in side view FIG. 3 Tamping process with tamping units according to FIG. 2 at a first sleeper spacing FIG. 4 Tamping process with tamping units according to FIG. 2 at a second sleeper spacing FIG. 5 Tamping process with tamping units according to FIG. 2 at a third sleeper spacing FIG. 6 Tamping unit in front view FIG. 7 Tamping process with tamping units according to FIG. 2 at the start of work FIG. 8 Tamping processes with tamping units according to FIG. 2 in a 3-sleeper mode FIG. 9 Tamping process with two tamping units at a first sleeper spacing FIG. 10 Tamping process with two tamping units at a second sleeper spacing FIG. 11 Tamping process with two tamping units at a third sleeper spacing FIG. 12 Tamping processes with two tamping units in a 2-sleeper mode

According to the invention, the tamping units 9 are arranged on the machine frame 8 so they can be shifted towards each other in the longitudinal direction of the machine 7. In FIG. 2, for example, three tamping units 9 are arranged on the machine frame 8 by means of a shared carrier 30. The middle tamping unit 9 is fixed to the carrier 30. The front and the rear tamping unit 9 are mounted on guide rods 31 in a longitudinally shiftable manner and can be adjusted in relation to the middle tamping unit 9 by means of longitudinal actuators 32. The longitudinal actuators 32 are actuated by means of a control device 33, which is designed as part of the machine control 28 or as a separate control. The control device 33 is given a current sleeper spacing t in order to position the tamping units 9 towards each other in the longitudinal direction of the machine 7 via the longitudinal actuators 32. The sleeper spacing t is preferably preset automatically by means of the sensor device 21. Alternatively, the longitudinal positions of the tamping units 9 can be adjusted according to the sleeper spacing t by an operator 13.

Figure 6:
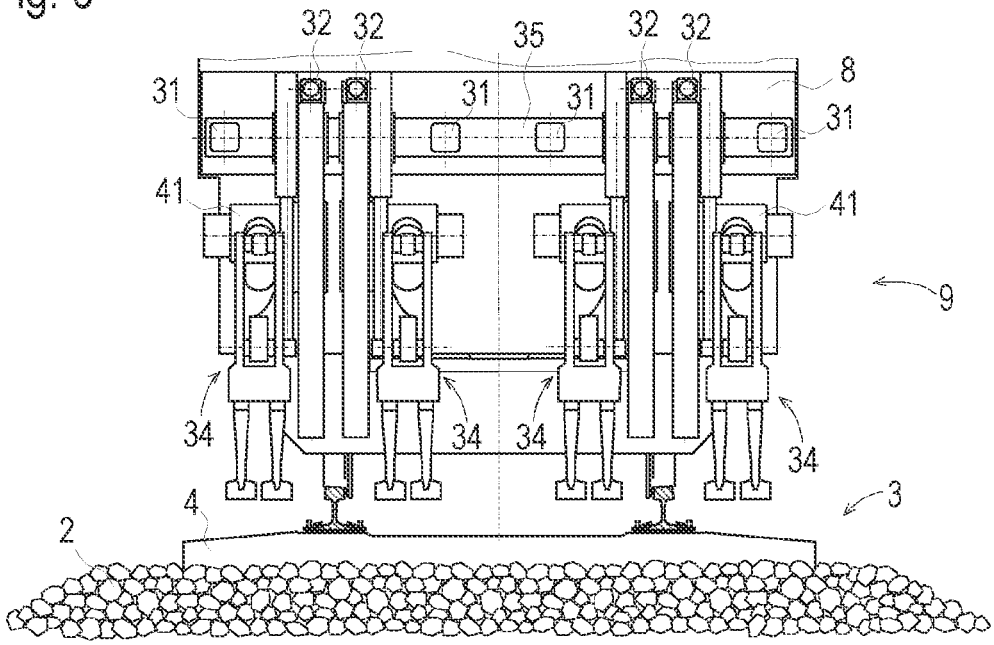

Each tamping unit 9 comprises tamping unit segments 34 arranged next to each other in the transverse direction of the track, as shown in FIG. 6. The respective tamping unit segment 34 comprises a tamping tool carrier 36 which is mounted on the associated vertical guides 38 of a tamping unit frame 39, adjustable in height by means of a height-adjustment drive 37. Opposite tamping tools 40 are tiltably mounted on the respective tamping tool carrier 36 in the longitudinal direction of the machine 7.

In addition, a vibration drive 41 (e.g. eccentric drive) is arranged on the respective tamping tool carrier 36, to which the tamping tools 40 are coupled via squeezing drives 42. In an alternative variant not shown, a hydraulic cylinder is arranged between the tamping tool carrier 36 and the respective tamping tool 40, which is set up both as a vibration drive 41 as well as a squeezing drive 42. A pulsating hydraulic pressure is applied to the hydraulic cylinder to generate vibration. During a squeezing process, the pulsating hydraulic pressure superimposes the squeezing pressure generated by means of the hydraulic cylinder.

Each tamping tool 40 comprises a pivoting lever 43 with an upper and a lower lever arm. The pivoting lever 43 is mounted on the associated tamping tool carrier 36, with the upper lever arm being connected to the associated squeezing drive 42. Two tamping tines 44 are usually attached to the free lower lever arm.

Figure 3:
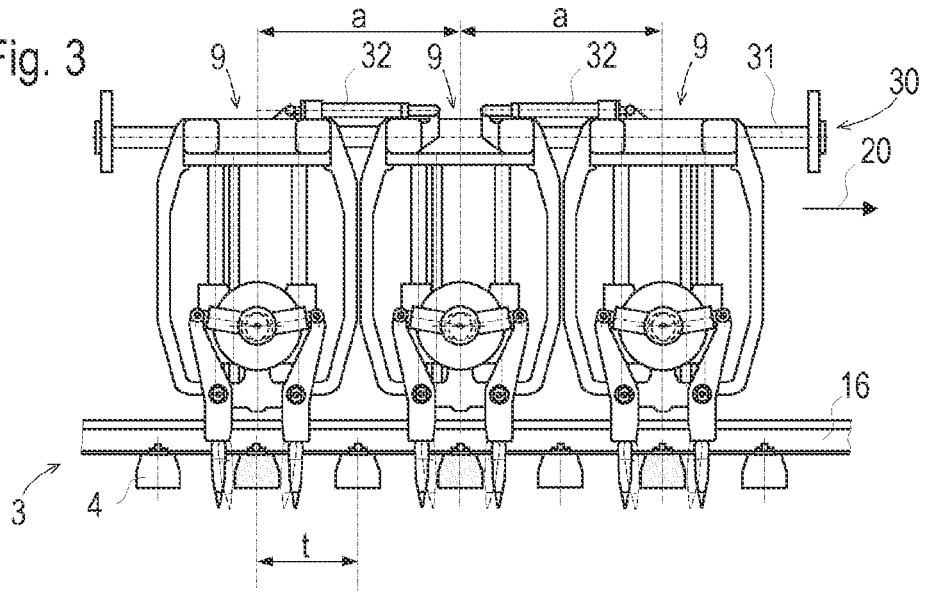
Figure 4:
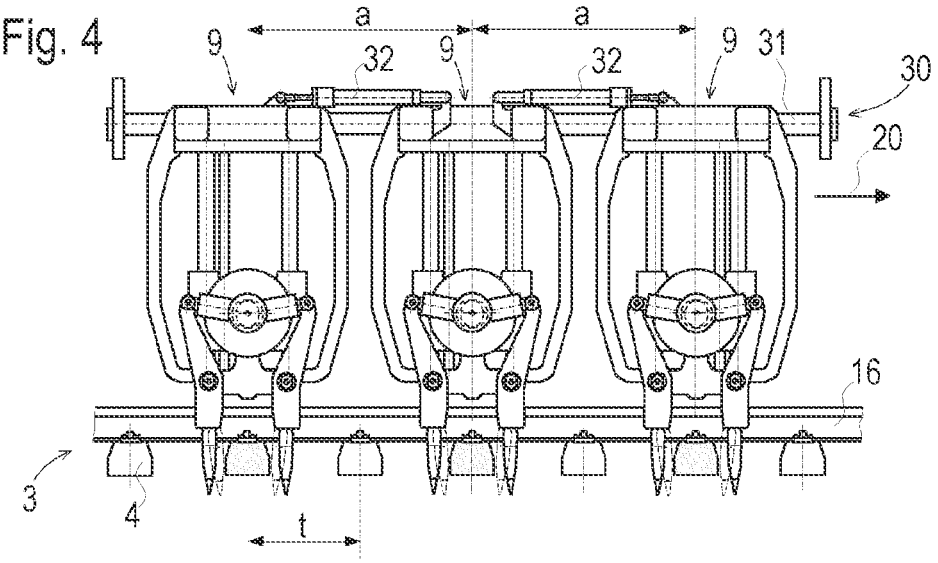
Figure 5:
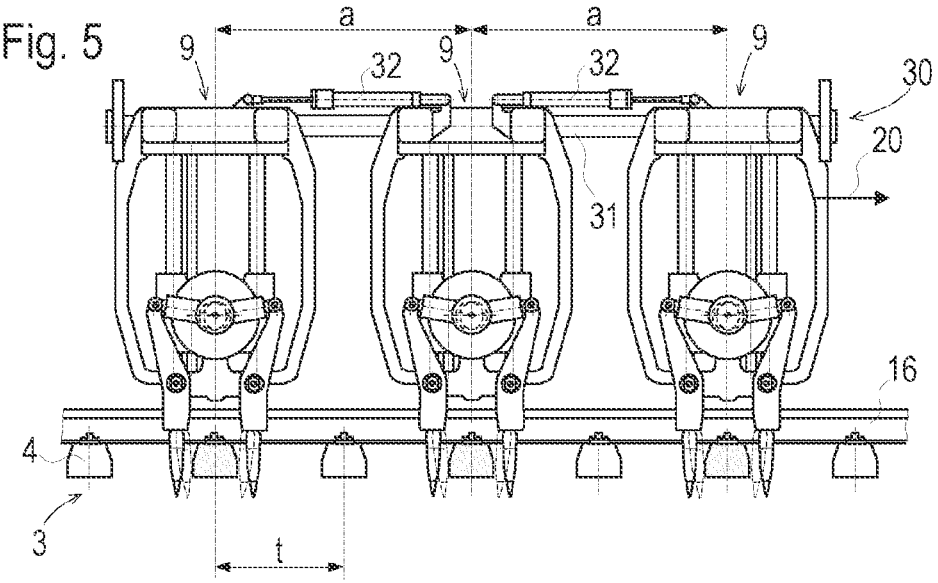

FIGS. 3 to 5 show the tamping units 9 according to FIG. 2 when tamping sleepers 4 with different sleeper spacing t. In FIG. 3, the sleeper spacing t is the smallest. Here, the tamping units 9 are moved towards each other in the longitudinal direction of the machine 7 by means of the longitudinal actuators 32. In the process, a symmetry plane of the respective tamping unit 9 in working position is aligned with a symmetry plane of the sleeper 4 to be tamped. In FIG. 4, the tamping units 9 have a correspondingly increased distance a from each other when the sleeper spacing t is increased. FIG. 5 shows the tamping units 9 with the greatest distance a from each other for tamping sleepers 4 with maximum sleeper spacing t.

A tamping cycle is divided into several phases. In a first phase, the respective tamping unit 9 is positioned above the sleepers 4 to be tamped. Specifically, the tamping tines 44 are positioned above the sleeper cribs located between the sleepers 4. This is done with the machines 1 or the machine frame 8 moving forward and by positioning the tamping units 9 towards each other according to the preset sleeper spacing t. The tamping tools 40 remain in an initial position in which the tamping tines 44 are vertically aligned.

In a second phase of the tamping cycle, the tamping tool carriers 36 with the tamping tools 40 located thereon are lowered. During this process, the vibrating tamping tines 44 penetrate the ballast bed 2. During a third phase, the tamping tines 44 of the opposite tamping tools 40 are squeezed towards each other. The kinetic energy of the tamping tools 40 is transferred to the ballast grains of the ballast bed 2 by means of tamping tine plates located on the tamping tines 44. The ballast grains start to vibrate and take on a fluid-like state. The result is a denser packing and a rearrangement of the ballast grains below the respective sleeper 4.

In a fourth phase of the tamping cycle, the tamping tines 44 are returned by means of the squeezing drives 42 and pulled out of the ballast bed 2 by lifting the tamping tool carriers 36. The actual tamping process thus comprises the second, third, and fourth phases of a tamping cycle. As soon as the tamping tines 22 are lifted above the top edge of the sleeper, the tamping units are moved forward in the direction of work 25, and a new tamping cycle begins. For example, the forward movement is adjusted to the current sleeper spacing t by means of a distance measuring device 45 arranged on the track tamping machine 1.

FIG. 6 shows that two separately lowerable tamping unit segments 34 are assigned to each rail 16 of the track 3. Thus, the respective tamping unit 9 comprises four tamping unit segments 34 arranged next to each other. In this context, it is advantageous if the tamping unit segments 34 of a tamping unit 9 are mounted on a shared carrier device 35 with transverse guides and are coupled with a respective drive for lateral displacement. This means that each tamping unit segment 34 can also be positioned crosswise to the longitudinal direction of the machine 7. This makes it easier to work in tight curves and the turnout area and crossings. Specifically, the respective tamping unit segment 34 can be positioned above each sleeper 4 with a consistent transverse distance from the associated rail 16. In a simplified variant not shown, a combined tamping unit segment 34 with tamping tools 40 on the inside of the rail and tamping tools 40 on the outside of the rail is assigned to each rail 16. For tamping a sleeper 4, tamping unit segments 14 of the same tamping unit 9 arranged next to each other are provided.

Figure 7:
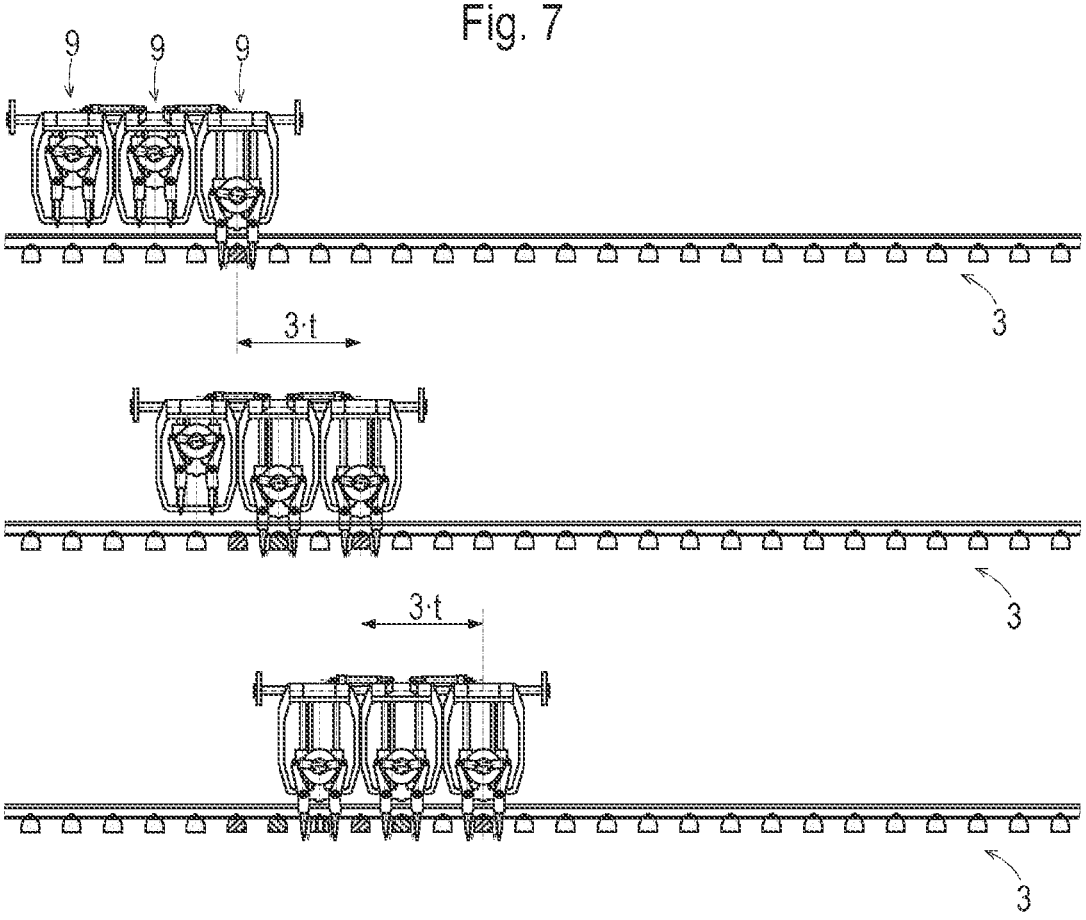

FIG. 7 shows the start of track maintenance with three tamping units 9 according to FIG. 2. At the start of maintenance, the tamping unit 9 at the very front is positioned above the first sleeper 4 to be tamped. Then a tamping process with this tamping unit 9 at the very front takes place. Subsequently, all tamping units 9 are moved forward by three sleeper spacings t (forward path=3·t), and a tamping process takes place with the very front and the middle tamping unit 9. In the final step of the start of maintenance, a forward movement of three sleeper spacings t takes place again. Subsequently, all tamping units 9 are used simultaneously.

Figure 8:
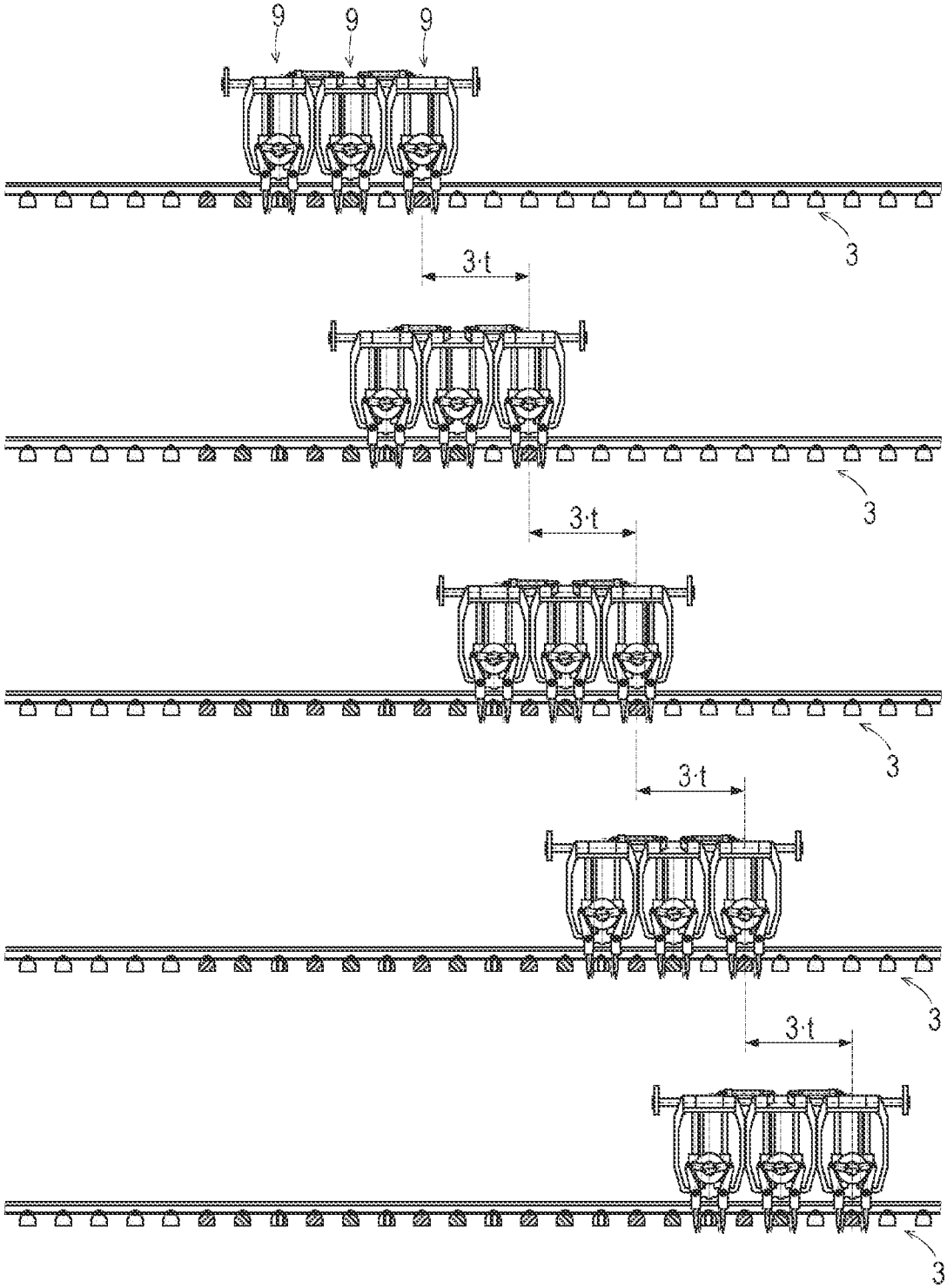

FIG. 8 shows that after the start of maintenance, a gradual forward movement by three sleeper spacings t leads to complete tamping of all sleepers 4 of the track section to be maintained (3-sleeper mode). If the sleeper spacing t changes in the course of track maintenance, the tamping units 9 are adjusted automatically or manually towards each other by means of the longitudinal actuators 32. Otherwise, the described 3-sleeper mode is retained.

Figure 9:
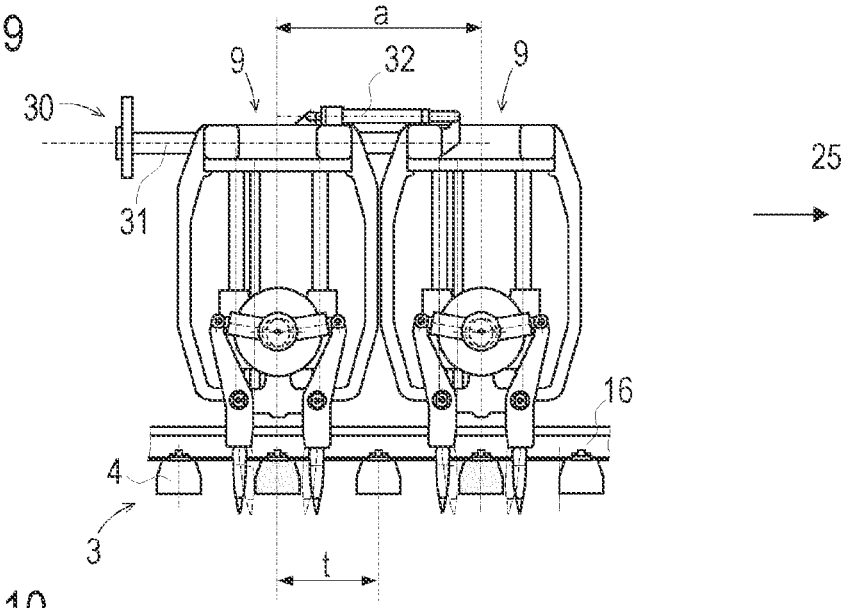
Figure 10:
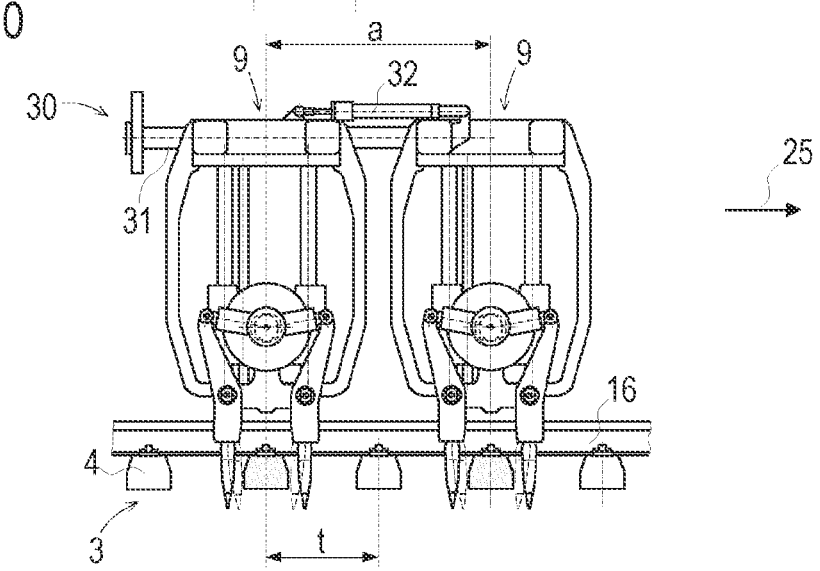
Figure 11:
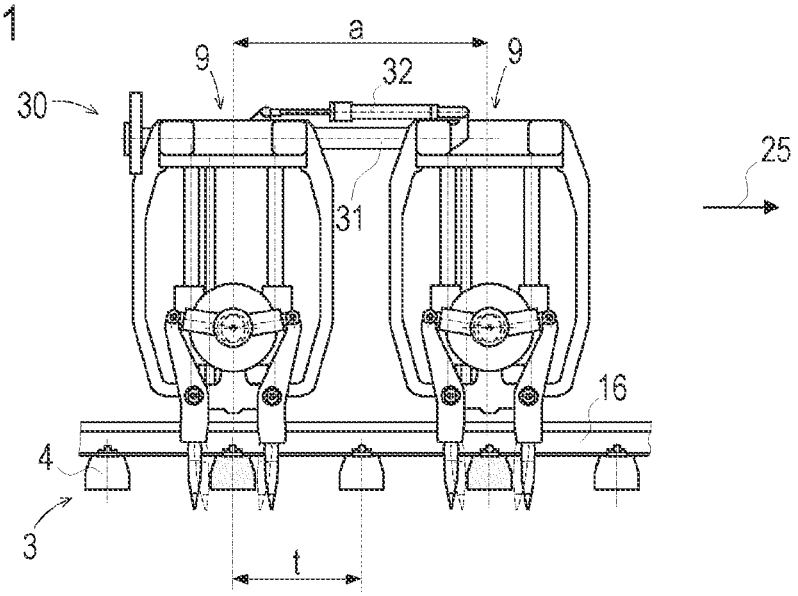

FIGS. 9 to 11 show an arrangement with two tamping units 9 with working positions for different sleeper spacings t. The front tamping unit 9 is fixed on the carrier 30 attached to the machine frame 8. The rear tamping unit 9 is mounted on guide rods 31 and can be adjusted in relation to the front tamping unit 9 in the longitudinal direction of the machine 7 by means of longitudinal actuators 32. Of course, the invention also includes other arrangements which enable the tamping units 9 to be adjusted in the longitudinal direction of the machine 7.

For example, a tamping unit 9 is directly attached to the machine frame 8. In another variant, all tamping units 9 are mounted on guide rods 31 aligned in the longitudinal direction of the machine 7 so they can be shifted towards each other. In this case, longitudinal shiftability of the machine frame in relation to a main frame may be omitted if the guide rods 31 are of corresponding length. Specifically, the guiding paths must be long enough to allow a shifting of all tamping units 9 by three sleeper spacings t.

In this variant, a continuous mode of operation of the track tamping machine 1 can also be realised without a so-called satellite. The track tamping machine 1 together with the machine frame 8 is continuously moved forward during a tamping process. At the same time, the tamping units 9 are moved on the guide rods 31 relative to the machine frame 8 against the direction of work 20. The relative movement is controlled by the longitudinal actuators 32 in such a way that the tamping units 9 remain positioned above the respective track maintenance point during a tamping process.

Another variant provides that the tamping unit segments 34 arranged next to each other of the respective tamping unit 9, can be shifted independently of each other in the longitudinal direction of the machine 7. Each tamping unit segment 34 has its own guide rods 31 and its own longitudinal actuator 32. In this way, the tamping unit segments 34 are adjustable to the longitudinal distances of Y-sleepers.

Figure 12:
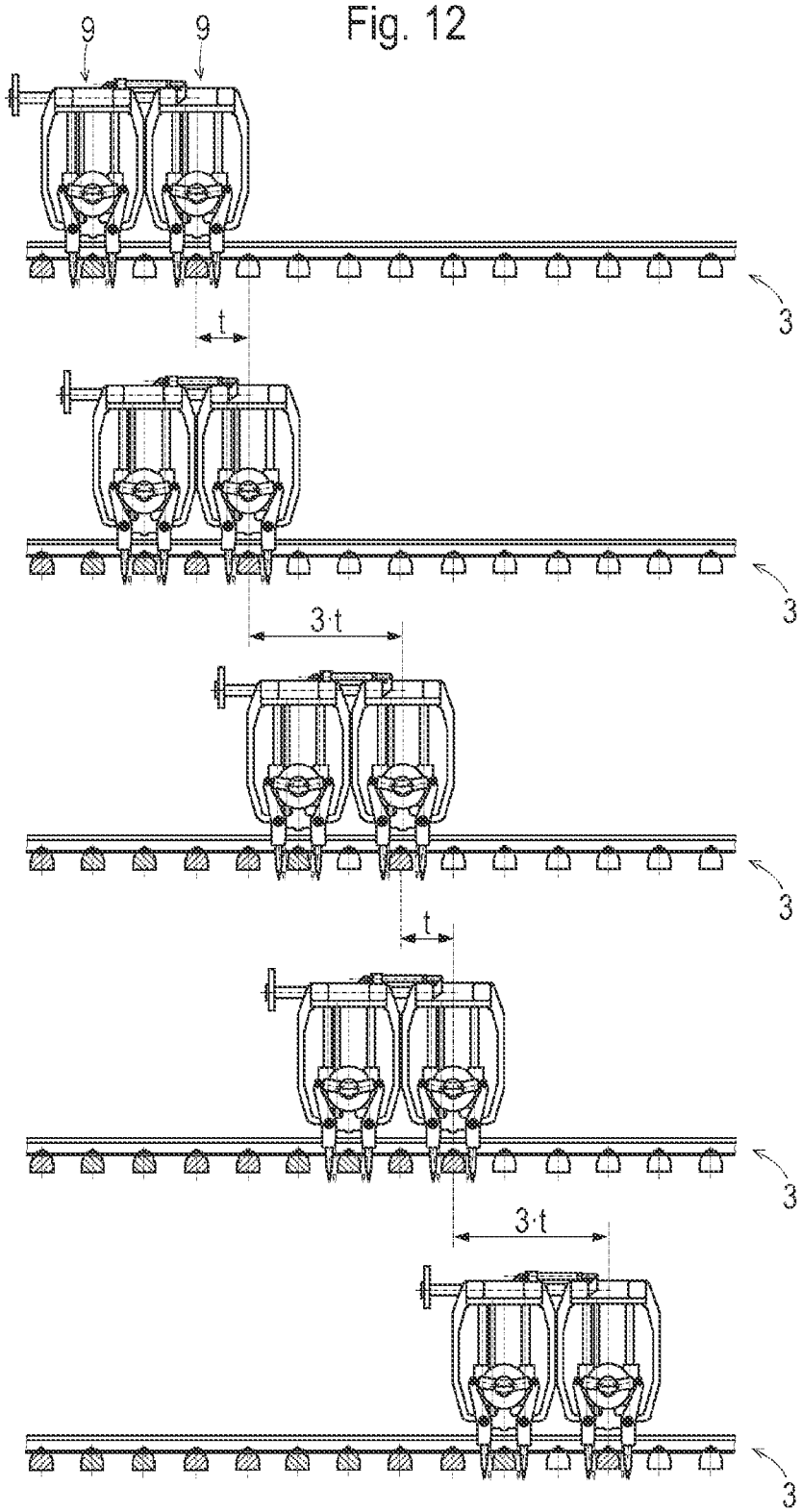

FIG. 12 shows track maintenance with two tamping units 9 arranged one behind the other. The distance a of the tamping units 9 from each other corresponds to double the sleeper spacing t as in FIGS. 9 to 11. After each tamping process, the tamping units 9 are moved forward alternately by three sleeper spacings t (forward path=3·t) and by one sleeper spacing t (forward path=t). In this way, all sleepers 4 are tamped in 2-sleeper mode. At the start of maintenance, only one tamping process is carried out with the front tamping unit 9 first, and then a forward movement by three sleeper spacings t takes place as is the case in 3-sleeper mode.

The invention claimed is:

1. A method for tamping a plurality of sleepers of a track supported in a ballast bed by means of a plurality of tamping units arranged one behind another on a machine frame of a track tamping machine with tamping tools opposite each other in pairs, with only one sleeper being tamped by means of a respective tamping unit of said plurality of tamping units during a tamping process, the method comprising the following steps:

actuating longitudinal actuators via a control device which is given a sleeper spacing of the sleepers to be tamped, positioning at least two tamping units towards each other in the longitudinal direction of the machine by means of the longitudinal actuators prior to a tamping process, in order to adjust the positions of said at least two tamping units to a given sleeper spacing, and tamping sleepers not arranged directly one behind the other during the tamping process;

detecting progressions of a ballast force acting on a tamping tool over a distance the tamping tool covers during a tamping process for each tamping unit by means of force and/or movement sensors arranged on an associated tamping tool, in order to derive a parameter for compaction control.

2. The method according to claim 1, wherein at least one position of the sleepers are detected by means of a sensor device arranged on the track tamping machine and that a sleeper spacing is derived from any detected positions.

3. The track tamping machine according to claim 1, wherein the respective tamping unit is symmetrically constructed with respect to a symmetry plane orthogonal to the longitudinal direction of the machine.

4. The track tamping machine according to claim 1, wherein the tamping units arranged one behind the other are identical in construction.

5. The track tamping machine according to claim 1, wherein each tamping unit comprises a plurality of tamping unit segments arranged next to each other crosswise to the longitudinal direction of the machine, which are attached to a shared carrier device and, in particular, have tamping tool carriers that can be adjusted in height separately.

6. A method for tamping a plurality of sleepers of a track supported in a ballast bed by means of a plurality of tamping units arranged one behind the other on a machine frame of a track tamping machine with tamping tools opposite each other in pairs, with only one sleeper being tamped by means of the respective tamping unit during a tamping process, the method comprising the following steps:

actuating longitudinal actuators via a control device, which is given a sleeper spacing of the sleepers to be tamped, positioning the tamping units towards each other in the longitudinal direction of the machine by means of the longitudinal actuators prior to a tamping process, in order to adjust the positions of the tamping units to the given sleeper spacing, and tamping sleepers not arranged directly one behind the other during the tamping process;

lifting and laterally lining a track panel formed of sleepers and rails fixed thereon prior to tamping by means of a lifting and lining unit, and that a vertical position and a horizontal position of the rails are detected by means of a measuring device positioned in front of at least one tamping unit of said plurality of tamping units at a very front.

7. The method according to claim 6, wherein at a beginning of worksite maintenance, only the tamping unit at a very front tamps once so that the track panel is fixed in a lifted vertical position and a lined horizontal position.

8. The method according to claim 7, wherein in a case of three tamping units arranged one behind the other at a distance that is double the sleeper spacing, all three tamping units are moved forward by three sleeper spacings in a direction of work after a first tamping process, that tamping is carried out only with the very front and a middle tamping unit during a second tamping process, that all three tamping units are moved forward again by three sleeper spacings in the direction of work after the second tamping process, and that tamping is carried out with all three tamping units during a third tamping process.

9. A method for tamping a plurality of sleepers of a track supported in a ballast bed by means of a plurality of tamping units arranged one behind the other on a machine frame of a track tamping machine with tamping tools opposite each other in pairs, with only one sleeper being tamped by means of the respective tamping unit during a tamping process, the method comprising the following steps:

actuating longitudinal actuators via a control device, which is given a sleeper spacing of the sleepers to be tamped, positioning the tamping units towards each other in the longitudinal direction of the machine by means of the longitudinal actuators prior to a tamping process, in order to adjust the positions of the tamping units to the given sleeper spacing, and tamping sleepers arranged one behind the other;

tamping sleepers not arranged directly one behind the other during the tamping process;

wherein, in the case of three tamping units arranged one behind the other at a distance that is double the sleeper spacing, after an initial tamping of sleepers positioned directly one behind the other, all tamping units are moved forward by three sleeper spacings in the direction of work prior to a tamping process, and that tamping is carried out with all three tamping units during a tamping process.

10. The method according to claim 1, wherein for tamping Y-sleepers, one rail is tamped using the tamping unit at the very front, and that another rail is tamped using the tamping unit positioned behind the very front one.

11. A track tamping machine comprising:

a plurality of tamping units arranged one behind the other on a machine frame for a simultaneous tamping of a plurality of sleepers of a track;

each tamping unit comprising:

a tamping tool carrier having a height adjustment drive for adjusting the tamping tool carrier in height by means of a height-adjustment drive, with tamping tools opposite each other in pairs being mounted on the tamping tool carrier;

a plurality of drives to set each tamping tool carrier in vibration and can be squeezed towards each other;

wherein one of the tamping units arranged one behind the other is fixed to the machine frame and that at least one other tamping unit is mounted on longitudinal guide rods coupled to the machine frame;

wherein the machine is adapted to carry out a method according to claim 1 in such a way that the tamping units can be shifted towards each other in the longitudinal direction of the machine by means of longitudinal actuators, and that the longitudinal actuators can be actuated by means of a shared control device in order to position the tamping units at a distance from each other which corresponds to a multiple of a given sleeper spacing.

12. The track tamping machine according to claim 11, wherein each tamping tool comprises a tamping tine at a lower free end which is vertically aligned in a penetration position.

13. The track tamping machine according to claim 11, wherein a main frame supported on running gears is movable on the track, and that the machine frame with the tamping units is arranged so it can be shifted in relation to the main frame in the longitudinal direction of the machine.

* * * * *